United States Patent [19]

Stein

[11] 4,215,926

[45] Aug. 5, 1980

[54] PROCESS FOR CONDUCTING AMMONIA IN A DEVELOPING APPARATUS USED FOR DEVELOPING DIAZOTYPE COPYING MATERIAL

[75] Inventor: Eckehard Stein, Frankfurt am Main, Fed. Rep. of Germany

[73] Assignee: Hoechst Aktiengesellschaft, Fed. Rep. of Germany

[21] Appl. No.: 865,439

[22] Filed: Dec. 29, 1977

[30] Foreign Application Priority Data

Dec. 30, 1976 [DE] Fed. Rep. of Germany ..... 2659485

[51] Int. Cl.[2] ..... G03D 7/00

[52] U.S. Cl. ..... 354/300; 55/70

[58] Field of Search ..... 55/70, 47, 50, 51, 54, 55/89; 354/300

[56] References Cited

U.S. PATENT DOCUMENTS

| | | | |
|---|---|---|---|
| 1,999,546 | 4/1935 | Pyzel | 55/70 |
| 4,003,069 | 1/1977 | Hilgers | 354/300 |

FOREIGN PATENT DOCUMENTS

| | | | |
|---|---|---|---|
| 2337961 | 2/1975 | Fed. Rep. of Germany | 354/300 |
| 1473415 | 5/1971 | United Kingdom | 55/70 |
| 1365759 | 9/1974 | United Kingdom | 354/300 |
| 239277 | 12/1969 | U.S.S.R. | 55/70 |

*Primary Examiner*—Bernard Nozick
*Attorney, Agent, or Firm*—James E. Bryan

[57] ABSTRACT

This invention relates to an improvement in the process for conducting ammonia in a developing apparatus for developing diazotype copying material, wherein exhaust air laden with gaseous ammonia and composed of the developer medium escaping from a developing chamber and air, is conducted in at least one absorption vessel countercurrently to water capable of absorbing ammonia; wherein the ammonia water of relatively low concentration thus obtained is conducted in an evaporator countercurrently to a stream of water vapor; and wherein the ammonia gas/water vapor mixture thus obtained is used for preparing the gaseous developer medium; the improvement comprising completely condensing the ammonia gas/water vapor mixture discharged from the evaporator to form ammonia water of a relatively high concentration; storing the ammonia water in an ammonia water supply tank; introducing the ammonia water discharged from the ammonia water supply tank, at a constant rate, into an evaporator which is in direct connection with the developing chamber; and passing the ammonia gas/water vapor mixture produced by evaporation from the evaporator into the developing chamber. The invention also relates to an apparatus for performing the process.

6 Claims, 3 Drawing Figures

Figure 1:
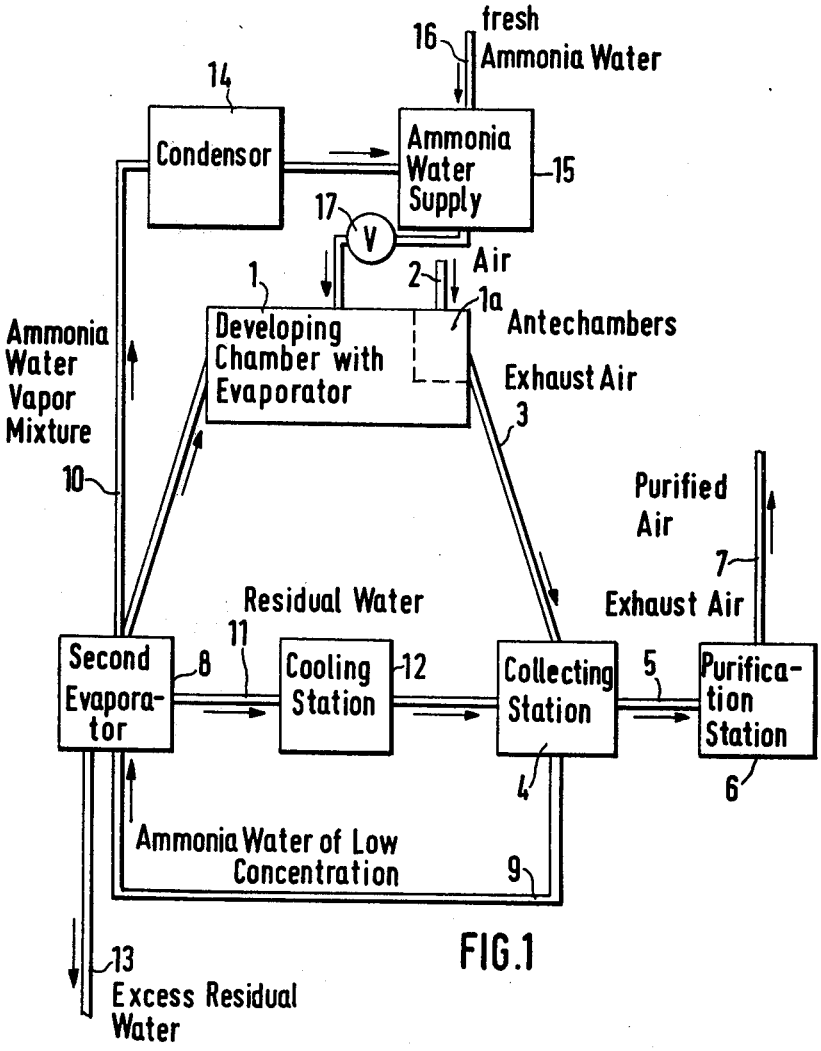

PROCESS FOR CONDUCTING AMMONIA IN A DEVELOPING APPARATUS USED FOR DEVELOPING DIAZOTYPE COPYING MATERIAL

The present invention relates to a process for conducting ammonia in a developing apparatus used for developing diazotype copying material.

The present process is based on the known, more general process for treating ammonia in copying apparatuses (German Patent Application No. P 23 37 961—British Pat. No. 1,473,415) wherein the ammonialaden exhaust air is conducted from the developing section into an ammonia receiving carrier medium in a collecting station, the ammonia being taken up by the carrier medium by a physical process, in particular by absorption. As the next step, the ammonia-containing carrier medium is passed from the collecting station to a separate releasing station where the ammonia is separated from the carrier medium under conditions which differ from those in the collecting station, especially by the application of heat, the carrier medium being regenerated. The ammonia thus obtained is recirculated to the developing station. In this connection, it is known to use water as the absorption means which serves as the carrier medium. In this case, the ammonia collecting station is composed of at least one absorption vessel. Preferably, a packed or plate-type column is used for absorption, in which the ammonia-containing exhaust air and the water used as the absorbing medium are conducted countercurrently. The ammonia in the ammonia water of low concentration produced in the collecting station is liberated in an evaporator serving as the releasing station and is recirculated to the developing station. The evaporator is a rectifying column with a heated pool. In the pool, nearly ammonia-free residual water is evaporated and the vapor thus produced flows through the rectifying column countercurrently to the ammonia water flowing down from the collecting station. Due to an exchange of material during evaporation and condensation in the rectifying column, ammonia is constantly expelled from the ammonia water fed into the rectifier. The virtually ammonia-free residual water thus produced collects in the pool and excess water, i.e. water not used for maintaining the rectifying process, is recirculated to the absorption vessel and is used again as the ammonia-absorbing carrier medium. The expelled ammonia leaves the rectifying column at the top thereof in the form of an ammonia gas/water vapor mixture with a relatively high ammonia content and is reintroduced into the developing station. The ammonia content, i.e. the concentration ratio between gaseous ammonia and water vapor in the mixture, is determined by the temperature at the top of the rectifying column.

Although ammonia is recirculated in accordance with this process, fresh ammonia must be replenished because ammonia gas undergoes a chemical reaction during development of the diazotype copying material and, furthermore, absorbed developer medium is carried out with the diazotype copying material leaving the developer section and thus is no longer available for recovery and recirculation. It is known to compensate for the losses occuring during development by adding fresh ammonia water to the ammonia water introduced at the top of the column and originating from the absorption vessel. This means that fresh ammonia water with a relatively high ammonia concentration and ammonia water originating from the absorption vessel and having a relatively low concentration are introduced into the rectifying column to produce the developer gas.

The production of the total quantity of developer gas required in the developing station is difficult, because the developing chamber should be ready, at any time, to develop even maximum web lengths of diazotype copying material, irrespective of the previous history of the ammonia recovery cycle in the machine, and, on the other hand, the ammonia recovery cycle should not be unduly loaded with unnecessarily large quantities of ammonia.

Moreover, the rectifying column is constantly subjected to different strains by varying quantities and concentrations of ammonia, so that it is almost impossible to attain a stationary condition in the rectifying column.

It may be feasible to create optimum conditions for the developer and for the rectifying column by appropriate controls. Thus, it is possible to measure the concentration, especially the ammonia concentration, in the developing chamber and feed it as the actual value to a control unit which controls the quantity and concentration of the ammonia gas/water vapor mixture to be released, the quantity and concentration being determined by the circulated ammonia and the fresh ammonia water added. In order to attain the required quantities and concentrations by means of the rectifying column, it is further necessary to provide controls to adjust the appropriate temperatures at the top of the column and suitable reflux rates within the column. Because the various control functions are interdependent on each other, such controls are expensive and in some cases may require a process control computer. Further, they may cause breakdowns, because it is difficult to adjust such systems.

It is the object of the present invention to improve the process described above in such a manner that the quantity of developer medium required for each operation is present in the developing station in each case and is replenished when necessary, without a control based on the ammonia content in the developing station and irrespective of the previous history of the ammonia recovery cycle. Nevertheless, the cycle should not be loaded by large quantities of ammonia, if possible. The process should allow a safe operation and should be realizable with a relatively low expenditure on equipment and with as low an energy consumption as possible.

In the present invention the ammonia/water vapor mixture produced in the rectifying column is not directly introduced into the developing chamber, but is first condensed and the condensate is converted into the developer medium. For this purpose, ammonia water, partly in the form of the condensate and partly in the form of fresh ammonia water, is constantly fed into and passed through the evaporator used for producing the ammonia gas/water vapor mixture required for development. The passage of the ammonia gas/water vapor mixture is so adjusted that it suffices, by itself, to produce the developer medium necessary to develop the maximum quantity of diazotype copying material transported per unit time through the developing chamber. If smaller quantities of diazotype copying material are passed, per unit time, through the developing chamber, or if the machine is running idle, only the difference between the quantity of ammonia water mixture thus introduced and the consumed developer medium, i.e.

the developer medium displaced from the developing chamber, must be treated in the cycle. Thus, the quantity of ammonia water mixture fed into the developing chamber is independent of the varying quantities of substances used for the individual steps of the process. The invention has the particularly advantageous effect that, maximally, the quantity of ammonia required for developing the largest possible quantity of diazotype copying material is fed per unit time into the cycle, viz. during a relatively long inoperative period. As a consequence, the expenditure on apparatus for the various steps of the process is small, as compared with the known process. If the same quantity of water is fed into the absorption vessel, as the absorbing medium, as in the known process, the absorption column used as the absorption vessel may be shorter, because the exhaust air fed into the absorption column invariably has a lower ammonia concentraton.

On the other hand, even if the length of the rectifying column is maintained, the expenditure on apparatus can be reduced, because less water, as the absorption medium, must be passed through the column according to the present invention. Consequently, less power is required for cooling the water used and a smaller diameter suffices for the absorption column, for the same thermal load. For the same reason, the rectifying column of the evaporator may, in this case, have a smaller diameter and less water vapor may be fed into it, so that less energy must be supplied to the evaporator.

In an advantageous embodiment of the inventive process, in which the residual water produced in the first evaporator by removing the gaseous ammonia from the ammonia water of low concentration, is heated to generate a stream of vapor, a measured portion of the residual water is cooled and recirculated into the absorption vessel. In this manner, not only the quantity of ammonia fed into the developing chamber is maintained constant, but the passage of the absorption medium, water, is maintained at a constant value which enables a favorable utilization and dimensioning of the coolant flow required for cooling the water before it is fed into the interior of the absorption vessel.

Advantageously, the process is performed using a developing apparatus for developing diazotype copying material in a developing chamber. The inventive feature incorporated in this developing apparatus is that a condenser is connected to the outlet of the second evaporator for the gaseous/vaporous ammonia-water mixture; that the outlet of this condenser, from which ammonia water of a relatively high ammonia concentration is discharged, is connected with the supply tank for ammonia water; and that a pipe equipped with a throttle leads from the outlet of the supply tank to the first evaporator, which is in connection with the developing chamber.

This developing apparatus is distinguished in that a relatively inexpensive equipment is used for the circulation of ammonia. The apparatus may be of a relatively compact design, and its energy consumption is relatively low.

More particularly, the developing chamber is provided with two ante-chambers, one at its in side and the other at its out side, into which the developer medium is expelled from the developing chamber. As further components of the suction system, a duct for the exhaust air is connected with the ante-chambers and connects them with a cooling device, which, in turn, is connected with the interior of the absorption vessel. Further, the suction system comprises a pump for the exhaust air which advantageously is connected with the exhaust air outlet of the absorption vessel, because in this manner it contacts only very little ammonia. The absorption vessel is advantageously an absorption column with packing material piled in its interior. The second evaporator advantageously is composed of a rectifying column to the bottom of which a heated pool is connected. The rectifying column is also filled with packing material. Inlets for the ammonia water of low concentration and, if desired, for the condensate collected in the developing chamber are provided at the head of the rectifying column. Further, the head of the rectifying column comprises an outlet for the gaseous/vaporous ammonia/water mixture. The pool is provided with an electric heating coil and has a discharge opening for substantially ammonia-free residual water. Advantageously, the discharge opening is designed as a siphon in order to avoid the escape of water vapor. The supply tank for the ammonia water from which the developer medium is obtained is connected, on the one hand, to the developer chamber through a condenser. On the other hand, fresh ammonia water may be introduced into the supply tank. The volume of the supply tank is so dimensioned that the quantity of fresh ammonia which may be added from the outside is sufficient for a predetermined period of time, for example a work day. Advantageously, the supply tank may be equipped with a simple level regulator which is connected, through a control unit, with a control valve or a pump which introduces fresh ammonia water when the level of ammonia water in the supply tank drops below a predetermined minimum value. The restrictor in the pipe leading from the supply tank to the first evaporator may be a simple narrowing of the pipe leading to the first evaporator, but advantageously it is an adjustable dosing valve. The first evaporator may be either an evaporator arranged within the developing chamber, or an outside evaporator from which a pipe supplying the generated ammonia gas/water vapor mixture leads to the developing chamber.

Advantageously, the restrictor is so dimensioned that the quantity of ammonia water mixture fed into the developing chamber remains constant and corresponds to the maximum quantity of developer medium entrained per unit time by the diazotype copying material, plus the quantities lost by displacement from the developing chamber. In this manner, care is taken that even maximum areas of diazotype copying material passed through the developing chamber are thoroughly developed and that, on the other hand, the peak values of the ammonia concentration in the cycle are kept as low as possible. For this purpose, it is assumed that the total quantity of ammonia water constantly introduced per unit time can be drawn off, in the gaseous or vaporous phase, by the suction device.

Further, the developing apparatus according to the invention comprises at least one first coolant cycle which is used for cooling the residual water fed into the absorption vessel and is connected to the cooling jacket of the absorption vessel, the construction being such that a second coolant cycle comprising a condenser is connected with the first coolant cycle and that a refrigerator is arranged in a branch which is common to the first and the second coolant cycles. Cooling is particularly inexpensive in the copying apparatus with the inventive ammonia cycling system, because the same refrigerator is used both for cooling the absorption vessel and the water fed into it, and also for cooling the condenser. The distribution of the currents of coolant advantageously may be controlled by two valves placed in the two branches branching off from a branching point for the purposes mentioned above.

The developing apparatus according to the invention comprising a rectifying column filled with packing material and a pool with a heating means arranged at the bottom of the rectifying column, the heating means being connected with a thermostat arranged at the top of the rectifying column, is advantageously so designed that the desired value of the thermostat is set to a temperature between 85° C. and 95° C. In this manner, the ammonia gas/water vapor mixture flowing from the rectifying column and being condensed in the condenser to form ammonia water approximately reaches an ammonia concentration corresponding to that of the normally used fresh ammonia water which contains 25 percent by weight of ammonia.

Figure 2:
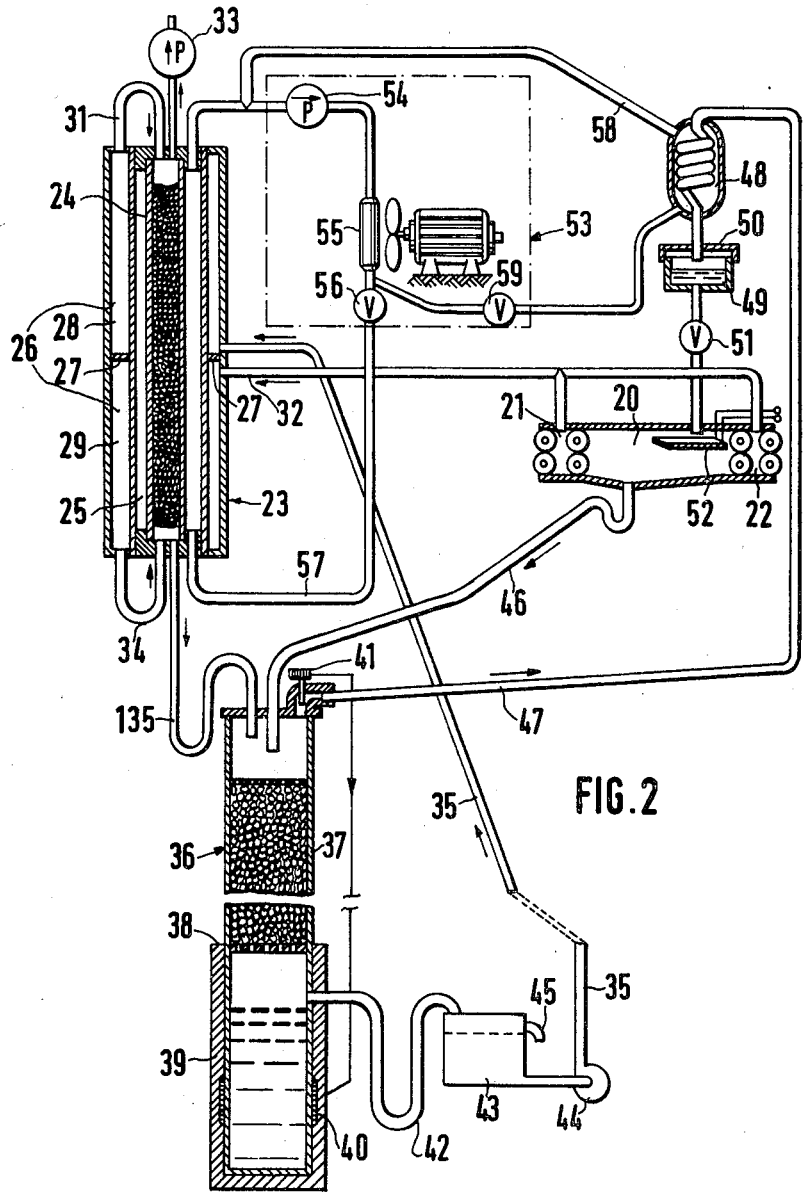
Figure 3:
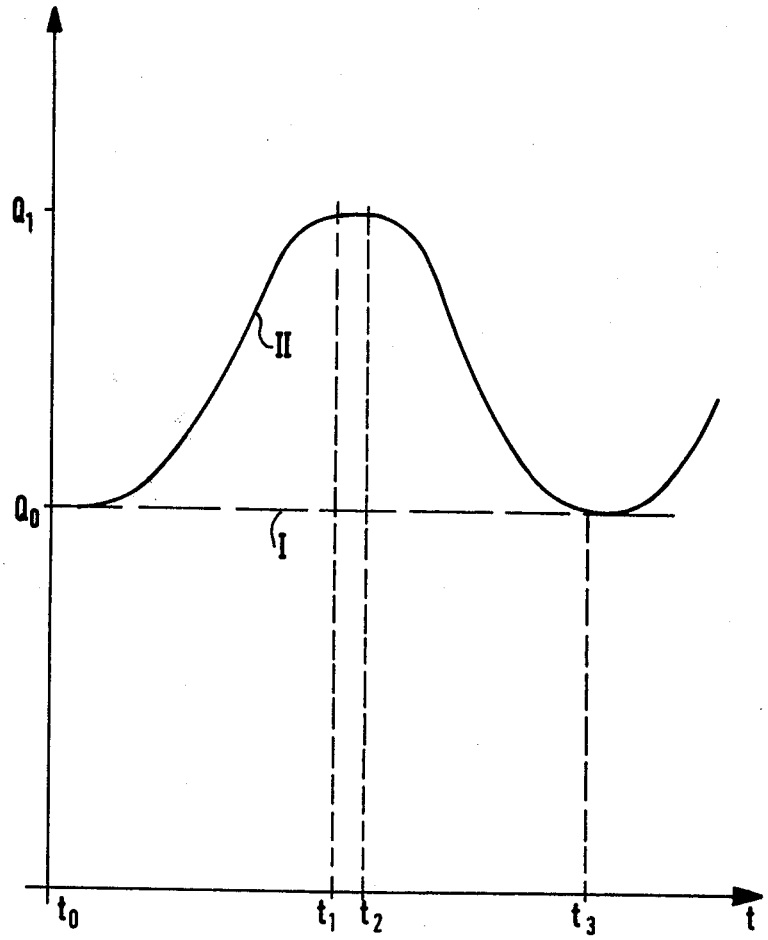

The invention will be further illustrated by reference to the accompanying drawings, in which FIG. 1 is a diagrammatic representation of the ammonia and carrier medium cycle, FIG. 2 shows, partly in section, a developing apparatus for developing diazotype coyping material, which comprises means for conducting ammonia and the carrier medium in a cycle, and FIG. 3 is a diagram showing the passage of the ammonia/water mixture fed into the developing chamber of the developing apparatus, as compared with the passage expected in accordance with the prior art.

In FIG. 1, developer gas is displaced through the inlet and outlet openings of the developing chamber 1 into the ante-chambers 1*a* adjacent the openings; by means of these ante-chambers, an escape of the developer gas into the surroundings is avoided. Through the openings of the ante-chambers 1*a*, air is drawn from the outside in the direction of the arrow 2, and exhaust air 3 is drawn from the ante-chambers 1*a* and conducted into an absorption vessel 4. The exhaust air contains the developer gas medium comprising gaseous ammonia and water vapor, in admixture with air drawn in from the outside. The absorption vessel may be a single absorption column filled with packing material, or may comprise a plurality of absorption columns connected in series. If necessary, the exhaust air 5 leaving the absorption vessel is additionally conducted to an after-cleaning station 6 which may comprise a vessel containing an aqueous citric acid solution for chemically bounding the small amounts of ammonia still present in the exhaust air. Finally, the purified exhaust air leaves the after-cleaning station in the direction of the arrow 7.

The ammonia absorbed in water in the absorption vessel 4 forms ammonia water with a relatively low ammonia concentration which is conducted in the direction of the arrow 9 to the second evaporator 8. The second evaporator advantageously is composed of a packed rectifying column with a heated pool at its bottom. The ammonia is separated out of the ammonia water with the low ammonia concentration introduced into the evaporator and leaves the evaporator in the form of gaseous ammonia in the direction of the arrow 10, together with water vapor. Further, residual water which is substantially free from ammonia and thus readily absorbs ammonia also leaves the second evaporator in the direction of the arrow 11 and flows to a refrigerator 12 from where it is returned to the absorption vessel 4. Excess residual water, which, the same as the residual water flowing in the direction of the arrow 11, has only a very low ammonia concentration, is released into the surroundings in the direction of the arrow 13.

The ammonia/water vapor mixture flowing in the direction of the arrow 10 is completely condensed in a condenser 14 and is conducted to the ammonia water supply tank 15 in the form of ammonia water with a relatively high ammonia concentration. Furthermore, fresh ammonia water may be added to the ammonia water supply tank, as indicated by the arrow 16. From the ammonia water supply tank 15, ammonia water flows at a constant rate through the restrictor 17 into the interior of the developing chamber 1 in which the first evaporator is arranged, thus generating gaseous/vaporous developer medium of a predetermined concentration and quantity from the ammonia fed in. By dimensioning the restrictor, sufficient ammonia water of the desired concentration is supplied to the developing chamber that the necessary concentration of gaseous developer medium is maintained even if a maximum quantity of diazotype copying material passes through the developing chamber and causes a maximum quantity of developer medium to be entrained by such passage or lost by displacement. The ammonia concentration of the ammonia water supplied to the developing chamber through the restrictor 17 is substantially constant, because within the supply tank 15 the fresh ammonia water is mixed with a relatively large quantity of recovered ammonia water. Due to the buffering effect of the supply tank 15, any variations in the concentration of the recovered ammonia water, which may occur, do not become fully effective on the ammonia water introduced into the developing chamber through the restrictor. Apart from that, variations in the concentration of the recovered ammonia water can be substantially avoided by appropriately controlling the temperature of the second evaporator.

The branched coolant cycle used for cooling the condenser 14, the refrigerator 12, and the absorption vessel 14 is not shown in FIG. 1. Details of the coolant system are shown in FIG. 2, which is described as follows:

In FIG. 2, the developing chamber is designated as 20 and the ante-chambers with which it is equipped are numbered 21 and 22. The ante-chambers are formed by two pairs of rollers each, which are provided for transporting the sheets of diazotype copying material through the developing chamber. An absorption vessel 23 is provided for absorbing the ammonia drawn off from the ante-chambers 21 and 22.

The ammonia gas/water vapor mixture escaping from the developing chamber 20 into the ante-chambers 21 and 22 is mixed, in an undesirable manner, with air which penetrates into the ante-chambers between the rollers of the boundary pairs of rollers. The gas mixture may contain about 10 percent by volume of ammonia. If this gas-air mixture is directly released into the surrounding air, such an ammonia concentration is considerable and undesirable from the point of view of ecology. On the other hand, the ammonia concentration is not high enough for the mixture of air and ammonia gas to be directly recirculated into the developing chamber.

Therefore, the mixture comprising air, gaseous ammonia, and water vapor is introduced into an absorption vessel 23 in which it rises countercurrently to a stream of water. More in detail, the absorption vessel 23 comprises an absorption chamber 24, a cooling jacket 25 arranged concentrically with the absorption chamber 24, and a likewise concentric jacket space 26. The interior of the absorption chamber is substantially filled with packing material. The jacket space 26 is subdivided by a partition 27 into an upper chamber 28 and a lower chamber 29. The upper chamber 28 is connected with a water supply pipe and serves as a pre-cooling zone for the water. The pre-cooled water leaves the upper chamber 28 by the pipe 31 and is introduced from above into the absorption chamber 24. The lower chamber 29 is provided with an exhaust air duct 32 for the exhaust air drawn off from the ante-chambers 21 and 22. For this purpose, a pump 33 is arranged at the top of the absorption vessel. The pump and the draw-off pipe substantially constitute the suction device. The lower chamber 29 of the jacket space serves as a pre-cooling zone for the exhaust air which leaves the lower chamber 29 by the pipe 34 and is introduced into the absorption chamber. In this manner, the full length of the absorption chamber is available for the exchange of materials and is not used for cooling.

Concerning the cooling system, according to another embodiment of the inventive apparatus, the exhaust air introduced into the absorption chamber is cooled in a separate pre-cooling unit, so that the absorption vessel has only a cooling jacket for cooling the absorption chamber, but not for pre-cooling the exhaust air. Further details of the arrangement of the cooling elements will be discussed further below.

The exhaust air flows from below into the absorption chamber, countercurrently to the water flowing down from above. The ammonia contained in the exhaust air is absorbed by the water and forms ammonia water with a relatively low ammonia concentration of not more than 10 percent by weight, which leaves the absorption vessel through a U-shaped discharge pipe 135 that is attached to the bottom of the absorption vessel and leads to the top of the second evaporator 36 with the rectifying column 37. The rectifying column 37 is also filled with packing material piled on the perforated bottom 38. At the foot of the rectifying column, a pool 39 is arranged which is provided with a heating coil 40. The heating coil 40 is supplied with energy through a thermostat 41 which is arranged at the top of the rectifying column and serves to control the temperature at the top. In the pool 39, which contains residual water that is substantially free from ammonia, water vapor is generated and rises in the rectifying column 37. During its passage through the rectifying column, the water vapor takes part in an exchange of material with the ammonia water of relatively low concentration introduced at the top of the column.

Thus, at the top of the column an ammonia gas/water vapor mixture results, the concentration ratio of which is determined by the value set on the thermostat 41. Ammonia concentrations between 20 and 30 percent by weight are preferred.

The residual water flowing into the pool, on the other hand, is substantially free from ammonia and contains less than 0.1 g of ammonia per liter. Residual water which is not evaporated for the rectifying process is removed from the pool over a siphon 42 which forms a gas-tight seal from the surroundings. For this purpose, the residual water flows into a supply tank 43 to which a dosing pump 44 is connected for supplying the appropriate quantity of water to the absorption vessel. Excess residual water may be released into the open air through a pipe 45. In the case of very stringent requirements on the absence of ammonia in the residual water, it may be advisable to attach to the pipe 45 a vessel filled with citric acid in order to chemically bond any traces of ammonia still present in the residual water.

In addition to the ammonia water of low concentration which is produced in the absorption vessel 23, condensed water discharged from the developing chamber through a condensed water pipe 46 flows into the top of the rectifying column 37.

The ammonia gas/water vapor mixture obtained as the top product in the rectifying column 37 is passed through a pipe 47 to a condenser 48 where it is completely condensed. The condensate obtained which, depending upon the ammonia concentration of the top product, has an ammonia concentration between 20 and 30 percent by weight, flows into an ammonia water supply tank 49 which thus contains ammonia water of a relatively high concentration. The ammonia water supply tank not only holds the ammonia water flowing in from the condenser, but also fresh ammonia water which is introduced to replenish the ammonia entrained by the diazotype copying material from the developing chamber; for this purpose, the ammonia water supply tank 49 is provided with a removable lid 50. From the ammonia water supply tank 49, ammonia water of a relatively high concentration flows through a dosing valve 51 into the first evaporator 52 accommodated in the developing chamber. The dosing valve 51 is to adjusted that the ammonia gas concentration required for complete development of the diazotype copying material prevails in the developing chamber even if the widest possible web of diazotype material is being transported at maximum speed through the developing chamber. On the other hand, if the supply of copying material is interrupted or if the diazotype copying material is transported at a lower speed, the ammonia gas is displaced from the developing chamber into the ante-chambers 21 and 22 from where it is drawn off.

For cooling the absorption vessel 23, which means cooling the absorption chamber and pre-cooling the exhaust air, a refrigerator 53 is provided which also is used for supplying coolant to the condenser 48. The refrigerator 53 comprises a compressor 54, a second condenser 55, and a valve 56. A closed circuit pipe 57 circulates the coolant through the jacket space of the absorption vessel and returns it to the refrigerator. Parallel to this closed circuit pipe 57, a second pipe 58 is provided which supplies the condenser 48 with the coolant. A valve 59 is provided in the second closed circuit pipe 58. The currents of coolant are distributed in accordance with the setting of the valves 56 and 59.

The inventive process for the conduction of ammonia is particularly advantageous and the dimensions of the apparatus used for the process are particularly favorable if parameters of the following values are selected: For the absorption process packed glass towers of 33 mm internal diameter and 1 m length were connected in series. The overall length of packed columns was 3 m. Unglazed 5 mm ceramic Berl saddles were used as packing material. Each of the absorption vessels was surrounded by a 10 mm wide jacket space. Other than in the above described embodiment, the exhaust air supplied is not pre-cooled in the chambers of the absorption vessel, but by means of a separate cooling device.

The rectifying column connected downstream of the absorption vessel is also a packed tower containing the same packing material as the absorption vessel. The internal diameter of the rectifying column was 45 mm and the level of packing was 0.65 m. The temperature at the top of the column was adjusted by means of a two-point control system, using a temperature-dependent resistor to indicate the actual value.

The absorption vessel and the condenser connected with the top of the rectifying column were cooled by a 1000 kcal/h capacity refrigeration system in which a liquid cooling medium was recirculated.

It was assumed that about 1.3 $m^3$/h of exhaust air is drawn off from the ante-chambers of the developing apparatus and that this exhaust air contains not more than 10 percent by volume of ammonia. The quantity of absorption medium (distilled water) required for absorbing ammonia from the exhaust air to such a degree that the exhaust air contains residual ammonia of less than 20 ppm was found to be 1.2 l/h. Absorption took place at an average absorption temperature of 7.5° C.

During tests with the rectifying column, it was assumed that ammonia water with an ammonia concentration of from 5 to 10 percent by weight was introduced. At an average temperature of 92° C. of the rectifying column and an introduction of 10 percent by weight ammonia water, the ammonia gas/water vapor mixture obtained as the top product had an ammonia content of about 27 percent by weight, provided that more than about 0.8 l of ammonia was fed in per hour. If a 5 percent by weight ammonia solution was introduced, the average temperature of the column was about 94° C., when the two-point control device was set to the same desired value, and the ammonia concentration in the ammonia/water vapor mixture obtained as the top product was about 15 percent by weight.

The residual water obtained in the pool contained between 0.03 and 0.14 g of ammonia per liter of residual water, if 0.5 to 1.6 liters of 10 percent by weight ammonia water was introduced per hour. If 0.5 to 1.6 liters of ammonia water of a concentration of only 5 percent by weight were introduced per hour, the pool product assumed an ammonia concentration of between 0.02 and 0.07 percent by weight.

FIG. 3 shows the advantageous effect of the present process for ammonia conduction without laying claim to an exact quantitative correctness. FIG. 3 is a diagrammatic representation showing the quantity of ammonia fed per unit time into the developing chamber (ordinate)—independent of whether in the form of a gas or as a liquid—for different operational stages of the developing chamber, as a function of time (abscissa). The broken line I indicates the constant ammonia feed resulting from the present invention, because ammonia is introduced at a constant rate and at a practically constant ammonia concentration. This rate of flow of ammonia has the value $Q_0$. Curve II, which shows no interruptions, shows how the ammonia feed would change if the ammonia gas/water vapor mixture with the relatively high ammonia concentration recovered by means of the rectifying column were directly introduced into the developing chamber. It is deemed advisable and assumed that as much fresh ammonia water of relatively high ammonia concentration is introduced into the cycle as is necessary to guarantee the desired ammonia concentration in the developing chamber, even for the most unfavorable case where no additional ammonia is recovered. As in the case of the present process, this rate of flow is indicated as $Q_0$. If, prior to the point of time $t_0$, the maximum quantity of diazotype copying material which can be transported was developed in the developing chamber over a relatively long period of time, no losses caused by displacement will occur, as expected, and, therefore, no additional ammonia will be recovered in the rectifying column. At the point of time $t_0$, the total volume of ammonia introduced thus corresponds to the value $Q_0$. If the copying apparatus then runs idle, however, which means that no diazotype copying material is transported through the developing chamber, the total volume of the ammonia introduced is displaced from the developing chamber into the ante-chambers, and, after a dead time and delay determined by the parameters of the absorption vessel and the rectifying column, is almost completely recovered and re-introduced into the developing chamber. The amount of recovered ammonia must be added to the amount of fresh ammonia water introduced so that a total rate of introduction of $Q_1$ results. If, thereafter, diazotype copying material is again transported through the developing apparatus, so that ammonia is bonded in the diazotype copying material by a chemical process and as a condensate, the quantity of recovered ammonia diminishes from the point of time $t_2$, delayed only by the above stated dead time and delay, as a consequence of the reduced rate of displacement, and reaches a value of $Q_0$ at the point of time $t_3$, if a maximum quantity of diazotype material is passed through the developing chamber at that time. If diazotype copying material is then again introduced into the developing chamber, the total rate Q of ammonia increases again. In accordance with these variations in the rate of ammonia introduced, the losses caused by displacement also vary, so that, e.g., at the point of time $t_1$, when no copying material is being transported through the developing chamber, the quantity of ammonia which is displaced from the developing chamber and must be drawn off from the ante-chambers and recovered, has a value $Q_1$ which may be about double the value Q according to the invention. This means that the apparatus according to the invention for conducting ammonia may be relatively compact and that the recovered ammonia gas/water vapor mixture and the residual water will be subject to less significant variations in the concentration of ammonia.

It will be obvious to those skilled in the art that many modifications may be made within the scope of the present invention without departing from the spirit thereof, and the invention includes all such modifications.

What is claimed is:

1. In the process for conducting ammonia in a developing apparatus for developing diazotype copying material, wherein exhaust air laden with gaseous ammonia and composed of the developer medium escaping from a developing chamber and air, is conducted in at least one absorption vessel countercurrently to water capable of absorbing ammonia; wherein the ammonia water of relatively low concentration thus obtained is conducted in an evaporator countercurrently to a stream of water vapor; and wherein the ammonia gas/water vapor mixture thus obtained is used for preparing the gaseous developer medium;

the improvement comprising completely condensing the ammonia gas/water vapor mixture discharged from said evaporator to form ammonia water of a relatively high concentration; holding the ammonia water in an ammonia water supply tank; introducing the ammonia water discharged from the ammonia water supply tank, at a constant rate, into an evaporator which is in direct connection with the developing chamber; and passing the ammonia gas/water vapor mixture produced by evaporation from the evaporator into the developing chamber.

2. A process according to claim 1 including heating residual water produced in the said evaporator by separation of gaseous ammonia from the ammonia water of low concentration to produce a stream of vapor, cooling a measured quantity of residual water, and recirculating it into the absorption vessel.

3. A developing apparatus for developing diazotype copying material, comprising a developing chamber is which ammonia-containing developer medium is adapted to be contained and in which it is adapted to be vaporized by a first evaporator in direct, gas-conducting connection with the developing chamber;

a suction means for withdrawing ammonia-containing exhaust air from at least one ante-chamber adjoining the developing chamber;

an absorption vessel having an inlet opening for the exhaust air, an inlet opening for water capable of absorbing ammonia, and an outlet opening for ammonia water of low concentration;

means connecting said absorption vessel with said at least one ante-chamber adjoining the developing chamber;

a second evaporator having an inlet opening for ammonia water which is connected with the outlet opening of the absorption vessel, an outlet opening for the ammonia gas/water vapor mixture, and an outlet opening for residual water which is substantially free from ammonia;

a pipe provided between the outlet opening for the residual water and the inlet opening of the absorption vessel, for water capable of absorbing ammonia;

means for introducing the ammonia gas/water mixture into the developing chamber;

a supply tank for ammonia water of relatively high ammonia concentration to compensate for developer medium entrained from the developing chamber;

a condenser connected to the outlet opening of the second evaporator for the gaseous/vaporous ammonia/water mixture;

means connecting the outlet opening of the condenser with a supply tank for ammonia water;

and a pipe with a restrictor means connecting the outlet opening of the supply tank to the first evaporator.

4. A developing apparatus according to claim 3 including a dimensioned suction device, wherein the total quantity of ammonia and water in the gaseous phase and the vaporous phase, respectively, constantly introduced into the developing chamber per unit time can be drawn off, said restrictor means being so dimensioned that the quantity of ammonia/water mixture introduced into the developing chamber is constant and corresponds to the maximum quantity of developer medium which may be entrained by the diazotype copying material plus the losses caused by displacement from the developing chamber.

5. A developing apparatus according to claim 3 including at least one first coolant cycle which serves for cooling the residual water passed to the absorption vessel and being connected with a cooling jacket of the absorption vessel, a second coolant cycle connected with the first coolant cycle, a condenser interposed in said second coolant cycle, and a refrigerator means in a branch which is common to the first and to the second coolant cycles.

6. A developing apparatus according to claim 3 including a packed rectifying column adapted to have a pool at the bottom thereof, a heating unit adapted to heat said pool, means connecting said heating unit with a thermostat arranged at the top of the rectifying column, and means for adjusting the desired value of the thermostat to a temperature between 85° C. and 95° C.

* * * * *